US006524392B1

(12) United States Patent
Traenckner et al.

(10) Patent No.: US 6,524,392 B1
(45) **Date of Patent: *Feb. 25, 2003**

(54) USE OF WATER-SOLUBLE POLYMERIC POLYCARBOXYLATES IN CLEANER FORMULATIONS WITH ABRASIVE ACTION

(75) Inventors: Hans-Joachim Traenckner, Krefeld-Fischeln (DE); Hartwig Wendt, Köln (DE); Thomas Menzel, Hilden (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/525,136

(22) Filed: Mar. 14, 2000

Related U.S. Application Data

(62) Division of application No. 09/393,178, filed on Sep. 9, 1999.

(30) Foreign Application Priority Data

Sep. 15, 1998 (DE) ..... 198 42 054

(51) Int. Cl.[7] ..... C23G 1/02

(52) U.S. Cl. ..... 134/6; 134/22.1; 134/22.17; 134/22.18; 134/22.19; 134/34; 134/36; 134/38; 134/40; 134/42; 451/39; 451/40; 510/108; 510/245; 510/254; 510/252; 510/477; 510/478; 510/470; 510/509

(58) Field of Search ..... 510/108, 245, 510/254, 252, 477, 478, 509, 470; 134/6, 7, 22.1, 22.17, 22.18, 22.19, 34, 36, 40, 42, 38; 451/39, 40

(56) References Cited

U.S. PATENT DOCUMENTS

| | | | | | |
|---|---|---|---|---|---|
| 4,049,467 | A | * | 9/1977 | Robin | 134/2 |
| 4,817,342 | A | | 4/1989 | Martin et al. | 51/439 |
| 4,851,149 | A | * | 7/1989 | Carandang | 252/147 |
| 5,081,799 | A | | 1/1992 | Kirschner et al. | 51/410 |
| 5,083,402 | A | | 1/1992 | Kirschner et al. | 51/319 |
| 5,139,693 | A | * | 8/1992 | Wilms et al. | 252/108 |
| 5,487,695 | A | | 1/1996 | Shank | 451/102 |
| 5,505,749 | A | * | 4/1996 | Kirschner et al. | 51/309 |
| 5,512,071 | A | | 4/1996 | Yam et al. | 51/307 |
| 5,536,437 | A | * | 7/1996 | Motyka | 510/397 |
| 5,679,761 | A | | 10/1997 | Heuer et al. | 528/363 |
| 5,698,509 | A | | 12/1997 | Nedonchelle | 510/424 |
| 5,703,033 | A | * | 12/1997 | Sherry et al. | 510/237 |
| 5,756,444 | A | * | 5/1998 | Walters et al. | 510/299 |
| 5,767,057 | A | * | 6/1998 | Merz et al. | 510/452 |
| 5,821,214 | A | * | 10/1998 | Weibel | 510/368 |
| 5,906,973 | A | * | 5/1999 | Ouzounis et al. | 510/503 |
| 6,017,872 | A | | 1/2000 | Pedersen et al. | 510/424 |

FOREIGN PATENT DOCUMENTS

| | | |
|---|---|---|
| DE | 4210363 | 10/1993 |
| EP | 0561452 A1 | 9/1993 |
| EP | 057226 B1 | 1/1999 |
| EP | 0644257 B1 | 5/1999 |
| FR | 2106734 | 5/1972 |
| WO | WO91/15308 | 10/1991 |

* cited by examiner

*Primary Examiner*—Sharidan Carrillo
(74) *Attorney, Agent, or Firm*—Godfried R. Akorli; Diderico van Eyl

(57) ABSTRACT

Cleaning compositions which, as powder or as aqueous formulation based on sodium bicarbonate, sodium chloride and/or sugar, comprise a water-soluble polymeric polycarboxylate as dispersant with the exception of those formulations containing only sodium bicarbonate and polyaspartic acids and/or their salts, to the use of these cleaning compositions for the abrasive cleaning of hard surfaces. A method for cleaning surfaces contaminated with deposits using these cleaning compositions.

10 Claims, No Drawings

USE OF WATER-SOLUBLE POLYMERIC POLYCARBOXYLATES IN CLEANER FORMULATIONS WITH ABRASIVE ACTION

This application is a divisional of U.S. Ser. No. 09/393,178 filed Sep. 9, 1999.

BACKGROUND OF THE INVENTION

The present invention relates to cleaning compositions which, as powders or as aqueous formulations based on sodium bicarbonate, sodium chloride, sodium hydrogen carbonate, sodium sulfate and/or sugar, comprise a) a water-soluble polymeric polycarboxylate as dispersant and/or b) a chelating agent and/or c) a surfactant.

The invention also relates to the use of these cleaning compositions for the abrasive cleaning of hard surfaces, and also to a method of cleaning surfaces contaminated with deposits using these cleaning compositions. Excluded from instant patent application are those formulations based only on sodium bicarbonate and polyaspartic acids and/or their salts. These formulations are claimed in copending DE 19 842 053.6.

It is state of the art to clean hard surfaces such as metal or non-metallic surfaces, e.g., building walls or ceramics, with abrasive agents. This is carried out for reasons of hygiene or in order to prepare surfaces for a protective coating. The aim of the cleaning composition is to remove, from metallic and non-metallic surfaces, the mineral, vegetable and animal oils, fats, waxes and soiling and other inorganic and organic compounds and salts such as ash, powders, granules, dusts, pigments, fillers, soot, tar, organic polymers, and the like, which adhere thereto.

Cold cleaners are used to detach contaminants of the above-mentioned type from hard surfaces and to transfer them into the aqueous phase. Requirements placed on environmentally friendly cold cleaners of the first generation were rapid dissolution and detachment of the soiling and rapid separation of the oil and solvent phase from the aqueous phase and low solubility in water of surfactants, emulsifiers and solvents. The second generation, the group of rapidly separating cold cleaners, is based on surfactants or surfactant mixtures which form coarsely disperse water-in-oil emulsions which also break down relatively quickly. Environmentally friendly cold cleaners of the third generation use organic salts, which, because of their chemical structure, have a high affinity towards hard surfaces. Layers of soiling are undermined over their whole area, resulting in virtually complete removal of the soiling upon subsequent cleaning with water. The effectiveness of a cleaning composition is determined by its ability to wet and penetrate soiled surfaces, and thus to promote solubilization and dispersion.

The ability of a cleaning composition to be effective is thus a combination of a number of effects, namely the lowering of the interfacial tension between an aqueous and an oily phase and the influence of the interaction between particles and wash liquor as a result of penetration and salvation, association, absorption and hydration.

The technical solution to this problem usually involves using processes that spray abrasive cleaning compositions under high pressure. This can be carried out using an aqueous solution, suspension and dispersion of the cleaning composition or a suitable mixture of cleaning compositions with or without carriers. Also known, from U.S. Pat. No. 4,817,342, incorporated herein by reference in its entirety, are dry processes, i.e., ones which use compressed air, or combinations of dry ("sandblasting") and wet blasting techniques.

In low-pressure processes of U.S. Pat. No. 5,487,695, incorporated herein by reference in its entirety, the formation of large amounts of dust is avoided by mixing water and compressed air in the nozzle and so limiting the formation of soiling during use by means of a particular nozzle technology.

A frequently used method for the abrasive cleaning of surfaces is the sandblasting method. Sand is a very hard abrasive material which can be used effectively for removing paint or encrustations on metallic surfaces, such as steel. Although silicates are very useful for all types of abrasive blasting techniques, they have some serious disadvantages too.

A health risk for an operator is that microcrystalline silicate fractions which form as a result of silicate crystals being crushed on the surface to be cleaned can pass into the lungs and thus lead to serious health problems. In particular, the expenditure for cleaning the surrounding area when sandblasting is complete must be taken into account. For many surfaces, sand is too hard a material which permanently damages the structure of the surfaces to be cleaned, e.g., in the case of aluminum, plastics surfaces or wood. In the industrial sector, sand can enter machinery and can permanently damage engines and mechanisms.

For this reason, pressurized jet cleaning using sodium bicarbonate has been developed as an alternative to the silicate process. U.S. Pat. Nos. 5,081,799 and 5,083,402, incorporated herein by reference in their entirety, disclose the use of abrasive agents instead of sand, such as sodium chloride or sodium bicarbonate. Sodium bicarbonate is usually, for example, blasted onto the area to be cleaned at superatmospheric pressure with or without the addition of water. Here, the sodium bicarbonate crystals clean, firstly, in an abrasive manner, i.e., physically. Secondly, they provide a chemical cleaning power since, as a result of their alkalinity, they are also able to attack in a chemical manner and hydrolyze. It is likewise possible to use $SiO_2$-hydrophobicized particles (WO 91/15 308, incorporated herein by reference in its entirety) of inorganic salts, which significantly reduce the hygroscopicity of many salts and thus permit better industrial application because clumping in the high-pressure plant is largely suppressed. Sodium bicarbonate is not harmful to the environment and is readily soluble in water, meaning that any crystalline articles which remain can be washed away with water (U.S. Pat. No. 5,487,695, incorporated herein by reference in its entirety,).

A common characteristic of all of the processes described in the prior art and established in practice is that, irrespective of how the abrasive cleaning of surfaces is carried out in technical terms and irrespective of the abrasive materials and cleaning compositions used therefor, they must always be followed by a second, labor-intensive cleaning process. This shortcoming means that the soiling which has been removed and the spent cleaning composition must be cleaned away together, or sedimented solids must be collected and disposed of by other suitable measures. It is thus considerably time-consuming and costly to likewise have to post-treat and clean the area directly surrounding the cleaned area.

The object of the present invention was thus to undermine, dissolve, detach or rub down deposits of the above type using suitable cleaning compositions, and to disperse and stabilize the soiling in iso- and polydisperse manner as finely as possible in the wash liquor. The aim in particular was to largely suppress sedimentation processes in the wash liquor in order to be able to dispose of the liquor with as high a soiling content as possible directly in an environmentally friendly manner, thus satisfying the desired application requirements with regard to dispersibility of the waste water. In this way, the expenditure on post-treatment and cleaning of the surroundings can be eliminated or at least be considerably reduced.

At the same time, the known advantages of cleaning with sodium bicarbonate should be retained. The main advantages are the positive ecological properties of the material, its good cleaning action and solubility in water, and comparatively low health risk for the user. Moreover, appropriate choice of the pressure range allows the abrasive action of the material, which is in some cases hydrophobicized, to be influenced such that the structure of the surface to be cleaned remains undamaged.

SUMMARY OF THE INVENTION

The object of the present invention is achieved in that the above-described shortcoming can be largely overcome by incorporating a dispersant based on water-soluble polymeric polycarboxylates and a chelating agent and/or a surfactant into the cleaning composition. These and other features, aspects, and advantages of the present invention will become better understood with reference to the following description and appended claims.

DESCRIPTION OF THE INVENTION

The present invention provides cleaning compositions which, as powder and/or as aqueous formulation based on sodium bicarbonate, sodium chloride, sodium hydrogen carbonate, sodium sulfate and/or sugar, comprise a) a water-soluble polymeric polycarboxylate as a dispersant and b) a chelating agent and/or c) a surfactant, with the exception of those formulations containing only sodium bicarbonate and polyaspartic acids and/or their salts.

The present invention further provides for the use of the novel cleaning composition for cleaning metallic and non-metallic surfaces and also a method of cleaning these surfaces.

The present invention is based on a remarkable discovery. Surprisingly, the addition of the water-soluble polymeric polycarboxylates used according to the invention as dispersant, and a chelating agent and/or a surfactant achieves, largely independently of other active ingredients in the abrasive cleaning formulations, a significantly increased soiling content in the waste water and a significant lowering in the sedimentation of detached particles than is the case for conventional compositions. In many cases, furthermore, a higher cleaning performance of the novel compositions has been observed.

By contrast, these effects could not be achieved through the sole use of dispersants with the exclusion of abrasive additives.

Finally, it has been found that the use of the compositions used according to the invention enables laborious cleaning of the surrounding area to be dispensed with, and only relatively small amounts of sedimented particles, which predominantly consist of sodium bicarbonate, if any, have to be sprayed off using a small amount of water.

The main water-soluble carriers which are used according to the invention are sodium bicarbonate, sodium chloride, sodium hydrogen carbonate, sodium sulfate or sugar. These can be used individually as single carriers or as a mixture with one another. Preference is given to using hydrophobicized carriers which ensure easier handling. Preference is given to using carriers hydrophobicized with $SiO_2$.

The particle size of the carrier, in particular of the sodium bicarbonate, is usually chosen such that, according to sieve analysis, between 10 and 70% by weight of the material have a particle size between 50$\mu$ and 300$\mu$, preferably between 170$\mu$ and 280$\mu$.

The content of carrier in the cleaning compositions, in particular of sodium bicarbonate, is preferably from 20 to 95% by weight, in particular from 50 to 95% by weight. If sodium bicarbonate is used, other carriers can additionally be used in amounts up to 50% by weight, preferably between 1 and 20% by weight.

The dispersants used in the novel cleaning compositions are preferably from the group of water-soluble polyacrylates and their salts, polyaspartic acids and their salts and mixtures of these substances.

The polyacrylates are usually acrylic acid homopolymers or copolymers based on acrylic acid and maleic acid or based on maleic acid and methyl vinyl ether. They may have acidic, neutral or basic character. In cases where acrylic acid homopolymers or copolymers based on acrylic acids and maleic acid or based on maleic acid and methyl vinyl ether are used, the use of chelating agents and/or surfactant is not absolutely necessary.

Suitable polyaspartic acids are especially polyaspartic acid homopolymers and their salts according to WO 96/31 554, incorporated herein by reference in its entirety. Preference is given to using the sodium salt and the ammonium salt of polyaspartic acids, which are biodegradable and ecologically safe substances. It is of course also possible to use all other salts and/or water-soluble copolymers of polyaspartic acids and their salts. It is likewise possible to use the anhydride of polyaspartic acids, polysuccinimide (PSI).

Chelating agents are usually organic complexing agents, with which polyvalent metal ions react to form a ring. Preferred chelating agents are the sodium salts of ethylenediaminetetraacetic acid (EDTA), nitrilotriacetic acid (NTA) or iminodisuccinic acid (IDS). It is of course also possible to incorporate all other customary complexing agents such as those from the aminocarboxylic acid series.

In addition to customary soaps, suitable surfactants for the novel compositions are, in particular, synthetic surfactants from the classes of anionic and nonionic surfactants. Examples of particularly suitable surfactants are sodium alkanesulphonates and ethoxylated fatty alcohols.

The above-mentioned dispersants, chelating agents and surfactants are present individually or in mixtures in amounts of at least 5% by weight. In each case, the novel compositions comprise certain water-soluble polymeric polycarboxylates as the characterizing constituent. The minimum content for a noticeable effect is regarded as about 5% by weight. The upper limit of the content is not least determined by the price and is not generally above 15% by weight.

The dispersant used in the compositions is preferably the sodium salt of polyaspartic acids in amounts between 5 and 12% by weight. Depending on the type of technical implementation, e.g., dry or water-jet processes, with or without compressed air, the cleaner formulations comprise greater or lesser amounts of water. Preference is given to choosing those cleaner formulations which have a low tendency of inhibiting the scatterability and flowability of the cleaning composition. The content of water can thus be chosen freely within wide limits.

As well as the ingredients already mentioned, further additives may be present in the compositions. In this connection, particular mention may be made of dyes for characterizing the respective cleaner formulation and preservatives. The content of such auxiliaries and additives is generally no greater than 10% by weight, and in most cases is considerably less than this.

In use, a cleaning composition containing a water-soluble polymeric polycarboxylate is applied to a hard surface, e.g., a metallic or non-metallic surface such that the invention eliminates or considerably reduces the expenditure on post-treating and cleaning a hard surface and its surroundings. The invention undermines, dissolves, detaches or rubs down deposits from the hard surface, and disperses and stabilizes the soiling in an iso- and polydisperse manner as finely as possible. The invention largely suppresses sedimentation processes in the wash liquor in order to be enable the liquor to be directly disposed with as high a soiling content as possible in an environmentally friendly manner, thereby satisfying desired application requirements with regard to dispersibility of the waste water. Further, the invention can retain the advantages of cleaning with sodium bicarbonate, e.g., the positive ecological properties of the material, its good cleaning action and solubility in water, and comparatively low health risk for the user. Also, the invention allows a user to choose an appropriate pressure range when applying the composition such that the structure of the surface to be cleaned remains undamaged.

The invention is further illustrated but is not intended to be limited by the following examples in which all parts and percentages are by weight unless otherwise specified.

EXAMPLES

A number of typical guide formulations for abrasive cleaning compositions according to the invention are given below.

| Abrasive cleaner formulation based on polyaspartic acids (Table 1) | |
|---|---|
| Sodium bicarbonate | 20 to 95% by weight |
| Polyaspartic acids, sodium salt | 5 to 15% by weight |
| Chelating agent | 0.1 to 20% by weight |
| Surfactant | 0 to 20% by weight |
| Dyes | 0 to 1% by weight |

-continued

| Abrasive cleaner formulation based on polyaspartic acids (Table 1) | |
|---|---|
| Preservatives | 0 to 10% by weight |
| Water | to 100% by weight |

| Abrasive cleaner formulation based on acrylic acid homopolymer (Table 2) | |
|---|---|
| Sodium bicarbonate | 20 to 95% by weight |
| Acrylic acid homopolymer | 5 to 15% by weight |
| Chelating agent | 0 to 20% by weight |
| Surfactant | 0 to 20% by weight |
| Dyes | 0 to 1% by weight |
| Preservatives | 0 to 10% by weight |
| Water | to 100% by weight |

| Abrasive cleaner formulation based on acrylic acid copolymer (Table 3) | |
|---|---|
| Sodium bicarbonate | 20 to 95% by weight |
| Acrylic acid copolymer | 5 to 15% by weight |
| Chelating agent | 0 to 20% by weight |
| Surfactants | 0 to 20% by weight |
| Dyes | 0 to 1% by weight |
| Preservatives | 0 to 10% by weight |
| Water | to 100% by weight |

The novel cleaner formulations can be prepared in the simplest case by simply mixing all of the components in suitable dry-mixing units. In individual cases, however, it may be more appropriate to absorb the water-soluble polymeric polycarboxylates as aqueous dispersion on the carrier, or to process the carrier and the water-soluble polymeric polycarboxylates with water to give a suspension and then to introduce them in this form into the mixing unit.

The components given in Table 4 were mixed to give cleaning formulations 1 to 7. The contents in the table are given as per cent by weight and are always based on the active ingredient content of the raw materials.

TABLE 4

| Example | 1 | 2 | 3 | 4 | 5 | 6 | 7 |
|---|---|---|---|---|---|---|---|
| Sodium bicarbonate | 90 | 90 | 0 | 0 | 95 | 90 | 85 |
| Polyaspartic acids, sodium salt | 0 | 0 | 88 | 0 | 0 | 0 | 5 |
| Acrylic acid homopolymer | 8 | 0 | 0 | 95 | 0 | 0 | 0 |
| Acrylic acid copolymer | 0 | 8 | 0 | 0 | 0 | 0 | 0 |
| Chelating agent | 0 | 0 | 0 | 0 | 0 | 5 | 5 |
| Surfactant | 0 | 0 | 0 | 0 | 0 | 3 | 3 |
| Dyes | 0.1 | 0 | 0 | 0 | 0 | 0 | 0 |
| Preservatives | 0 | 0 | 0.5 | 0 | 0 | 0 | 0 |
| Water | to 100 | to 100 | to 100 | to 100 | to 100 | to 100 | to 100 |

TESTING THE CLEANING EFFECT

In order to ensure that the individual mixtures according to Examples 1 to 7 were tested under conditions, which as much as possible, simulated those met in practice, a reactor from a chemical production plant was chosen which was uniformly contaminated with chemicals on the outside. The surface of the reactor top was divided into seven segments and each segment was labeled. On each reactor segment each of the cleaner formulations according to Examples 1 to 7, and the cleaning performance and the soil-carrying capacity of the waste water was assessed visually. Assessment was on the following scale:

1 uniform and complete cleaning without residues; or very good soil-carrying capacity 2 almost complete cleaning, only slight residues; or good soil-carrying capacity 3 visible, but only non-uniform, cleaning; or clear soil-carrying capacity 4 slight, but only non-uniform cleaning; or low soil-carrying capacity 5 no cleaning performance; or no soil-carrying capacity The results in Table 5 clearly show the better result with the novel compositions:

TABLE 5

| Example | 1 | 2 | 3 | 4 | 5 | 6 | 7 |
|---|---|---|---|---|---|---|---|
| Cleaning effect | 1 | 1 | 5 | 5 | 2 | 2 | 1 |
| Soil-carrying capacity | 1 | 1 | 5 | 5 | 4 | 4 | 1 |

While Examples 3 and 4 in Table 5 give entirely unsatisfactory performances both as regards the soil-carrying capacity and also as regards the cleaning effects, the cleaning effect in the case of Examples 5 and 6 improves, whereas the soil-carrying capacity remains unsatisfactory. Examples 1, 2 and 7 give the best results both in terms of the cleaning capacity and also as regards the soil-carrying capacity.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A method comprising water-jetting, to a hard surface having deposits, an aqueous abrasive cleaning formulation consisting of:

(a) an abrasive selected from the group consisting of (i) sodium bicarbonate, (ii) sodium chloride, (iii) sodium sulfate, (iv) sugar, and (v) mixtures thereof, and (b) a dispersant selected from the group consisting of (i) polysuccinimides, (ii) polyaspartic acids, (iii) salts of polyaspartic acids, (iv) homopolymers or copolymers of acrylic acid, and (iv) mixtures thereof, and thereby cleaning the hard surface, wherein the abrasive cleaning formulation does not include formulations that contain only sodium bicarbonate and a dispersant selected from the group consisting of polyaspartic acid, and salts of polyaspartic acids.

2. The method of claim 1, wherein the abrasive cleaning formulation is water-jetted with compressed air.

3. The method of claim 1, wherein the abrasive cleaning formulation is water-jetted without compressed air.

4. The method of claim 1, wherein the abrasive cleaning formulation is water-jetted to a hard surface comprising a member selected from the group consisting of metal surfaces and nonmetallic surfaces.

5. The method of claim 1, wherein the method further comprises the step of removing deposits in a wash liquor containing (i) the abrasive cleaning formulation and (ii) deposits that are detached from the hard surface.

6. The method of claim 1, wherein the method further comprises the step of removing deposits in a wash liquor containing (i) the abrasive cleaning formulation and (ii) deposits that are detached from the hard surface, wherein the hard surface is cleaned without being subjected to a post-treatment.

7. The method of claim 1, wherein the process removes the deposits from the hard surface and disperses and stabilizes the deposits in a wash liquor.

8. The method of claim 1, wherein the content of the abrasive is from about 20 to about 95% by weight, and the content of the dispersant is from about 5 to about 15% by weight.

9. A method comprising:

A) water-jetting to a hard surface containing deposits, an aqueous abrasive cleaning formulation consisting of:

(a) an abrasive component selected from the group consisting of (i) sodium bicarbonate, (ii) sodium chloride, (iii) sodium sulfate, (iv) sugar, and (v) mixtures thereof, and (b) a dispersant selected from the group consisting of (i) polysuccinimides, (ii) polyaspartic acids, (iii) salts of polyaspartic acids, (iv) homopolymers or copolymers of acrylic acid, and (i) mixtures thereof, and thereby cleaning the hard surface, B) suppressing sedimentation of said deposits in a wash liquor that forms when the aqueous abrasive cleaning formulation is water-jetted to the hard surface, wherein the abrasive cleaning formulation does not include formulations that contain only sodium bicarbonate and a dispersant selected from the group consisting of polyaspartic acid, and salts of polyaspartic acids.

10. The method of claim 9, wherein the abrasive is present in an amount that ranges from about 20 to about 95% by weight.

* * * * *